US006018887A

United States Patent [19]

Kalaydjian

[11] Patent Number: 6,018,887

[45] Date of Patent: Feb. 1, 2000

[54] DRYING APPARATUS FOR PHOTO PRINTS

[76] Inventor: Arsen Kalaydjian, 365 W. California St., Glendale, Calif. 91203

[21] Appl. No.: 09/113,897

[22] Filed: Jul. 13, 1998

Related U.S. Application Data

[60] Provisional application No. 60/052,619, Jul. 15, 1997.

[51] Int. Cl.[7] ..... F26B 9/00

[52] U.S. Cl. ..... 34/621; 34/221; 34/227

[58] Field of Search ..... 34/427, 442, 444, 34/90, 107, 618, 621, 202, 218, 221, 227; 312/183, 184, 185; 396/573, 590, 633, 636, 622

[56] References Cited

U.S. PATENT DOCUMENTS

| | | | |
|---|---|---|---|
| 3,661,578 | 5/1972 | Mason | 34/95 X |
| 3,701,201 | 10/1972 | Drury | 34/202 X |
| 4,087,926 | 5/1978 | Breslau . | |
| 4,677,764 | 7/1987 | Carry . | |
| 5,014,446 | 5/1991 | Reesman . | |
| 5,077,570 | 12/1991 | Schell | 34/90 X |
| 5,323,546 | 6/1994 | Glover . | |
| 5,502,900 | 4/1996 | Hui . | |
| 5,704,135 | 1/1998 | Riahi | 34/621 X |

*Primary Examiner*—Stephen Gravini
*Attorney, Agent, or Firm*—Patent & Trademark Services; Joseph H. McGlynn

[57] ABSTRACT

An enclosure having a back wall which is made of a net-like material and unto which photo prints can be placed. A front part of the enclosure has at least one source of hot air which is directed to the back wall and switches which turn on and off the source of hot air and control the speed of the air.

2 Claims, 1 Drawing Sheet

DRYING APPARATUS FOR PHOTO PRINTS

This is a conversion of Provisional application Ser. No. 60/052,619, filed Jul. 15, 1997, to a Utility application.

BACKGROUND OF THE INVENTION

This invention relates, in general, to the drying of materials, and, in particular, to the drying of materials such as photographic paper.

DESCRIPTION OF THE PRIOR ART

In the prior art various types of dryers have been proposed. For example, U.S. Pat. No. 4,087,926 to Breslau et al discloses a photo print dryer with a pair of manually operated rolls which feed the prints into a drying rack.

U.S. Pat. No. 4,677,764 to Cerny discloses a planar drying surface with a water permeable grill and a fan which circulates heated air under and around wet prints.

U.S. Pat. No. 5,014,446 to Reesman discloses a blow dryer which cooperates with an enclosure for drying various articles.

U.S. Pat. No. 5,502,900 to Hui discloses a dish dryer having multiple, stacked supports and a source of hot air for drying dishes.

U.S. Pat. No. 5,323,546 to Glover et al discloses a print dryer having multiple stage heaters to dry photographic prints in steps.

SUMMARY OF THE INVENTION

The present invention comprises an enclosure having a back wall which is made of a net-like material and unto which photo prints can be placed. A front part of the enclosure has at least one source of hot air which is directed to the back wall and switches which turn on and off the source of hot air and control the speed of the air.

It is an object of the present invention to provide an improved and novel photo print drying apparatus.

It is an object of the present invention to provide an improved and novel photo print drying apparatus which has a support for holding the prints in a vertical position.

It is an object of the present invention to provide an improved and novel photo print drying apparatus in which the support for holding the prints in a vertical position has a plurality of apertures to aid in proper air circulation around the prints.

These and other objects and advantages of the present invention will be fully apparent from the following description, when taken in connection with the annexed drawings.

DESCRIPTION OF THE PREFERRED EMBODIMENT

Figure 1:
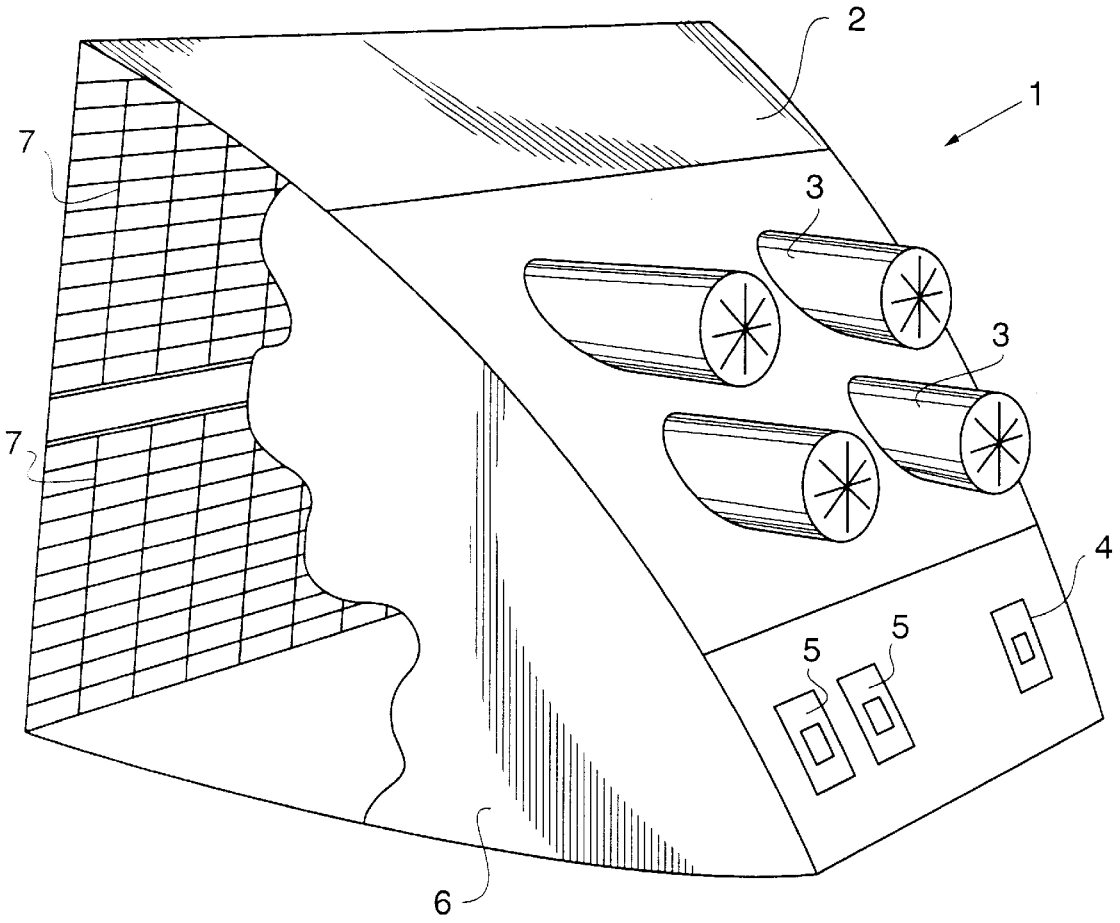
FIG. 1 is partial cut away, perspective view of the present invention.

Referring now to the drawings in greater detail, FIG. 1 shows the present invention 1 which comprises an enclosure 2 into which a plurality of conventional photo prints (not shown) can be placed in order to dry the prints.

As those skilled in the photo developing art are aware, when photos are developed they are passed through liquid developing fluids. The fluids leave the prints in a wet state and they must be dried. Handling of the prints while they are wet can damage the prints, and therefore care must be taken during the drying stage. A conventional method of drying photo prints is to hang the prints on a line and allow them to air dry with the source of the heat being the warm air in the darkroom.

Another method used in shown in the Glover et al and Breslau et al patents in which the prints are placed in an enclosure and hot air is passed over the prints. While these various methods work they have many drawbacks. For example, the Glover et al and Breslau et al patents involve complicated machinery that are expensive and are, therefore, suited more to a commercial type of development business. In addition, they do not provide adequate support for the prints which can cause the prints to "curl" during the drying process.

The "hanging on the line" while inexpensive, and therefore suitable to small businesses or to amateur photographers, also does not support the prints adequately.

The present invention provides an inexpensive apparatus for drying prints and which provides adequate support to prevent "curling". The enclosure 2 of the present invention has a series of sources of hot air 3 mounted in one wall of the enclosure. Although four sources of hot air 3 are shown in the drawing, it should be understood that more than or less than four sources can be employed without departing from the scope of the invention.

In addition, the sources of hot air 3 are show as being an integral part of the housing 2, however, they could be separate elements such as hair dryers which are mounted in apertures in the enclosure 2. Any conventional source of hot air could be used as the source of hot air 3 without departing from the scope of the invention.

Also mounted at the front of the enclosure 2 is a plurality of conventional switches 4, 5, which can control the sources of hot air 3. For example, the switches 5 can be used to turn on or off the sources of hot air 3, and the switch 4 can be used to control the speed of the hot air, i.e. high or low speed.

Also, it should be noted that while two "on/off" switches and one "high/low" switch are shown in the drawings, this is not the only combination of switches which can be used. For example a switch for each source of hot air 3 could be used, or one switch could control two or more sources of hot air 3. The same is true for the "high/low" switch 4. A "high/low" switch for each source of hot air 3 could be used, or one switch could control two or more sources of hot air 3.

Mounted on the back wall of the enclosure 2 is a plurality of "webs" 7. The "webs" consist of horizontal and vertical members which form apertures that will allow the hot air produced by the heat sources 3 to flow around the photos. The webs 7 could be made from any material that will not be adversely affected by the hot air. In addition, the webs should be at least slightly larger than the photos to allow for air flow.

Figure 2:
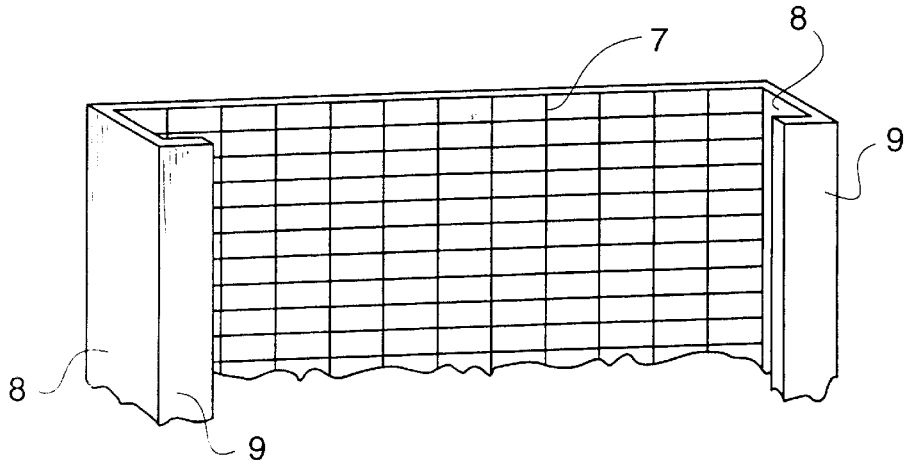
FIG. 2 is a partial view of the back wall of the enclosure of the present invention.

As shown in FIG. 2, the webs 7 have a groove formed by the side walls 8 and the flange 9 which will support the photos on their edges in order to prevent curling while the photos are drying. The groove should be only slightly larger than the thickness of the photos in order to hold the photos snugly.

The number of nets 7 can vary. For example, a net for each heat source 3 could be provided, or a single web for all the heat sources could be used. In addition, removable top and bottom supports could be attached to the nets 7, by any conventional means, to support the top and bottom of the photos if necessary.

Also, the back wall, which has the nets 7, could be hinged to the side walls 6, or attached in any other conventional manner, so it will be easier to place the photos on the nets 7. In the alternative, an access slot or opening could be provided in the top of the enclosure 2 to allow the photos to be placed onto the webs.

Although the Drying Apparatus for Photo Prints and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A dryer for photographic prints comprising:

an enclosure, said enclosure having at least one means for supplying heated air into said enclosure, means for turning, said at least one means for supplying heated air, on and off, means for supporting photographic prints while they are being dried, said means for supporting photographic prints comprising a wall having a plurality of openings therethrough, and a pair of flanges on opposite sides of said wall, said flanges overlying a portion of said wall and being spaced from said wall.

2. The dryer for photographic prints as claimed in claim 1, wherein said wall has a plurality of vertical components and a plurality of horizontal components, said plurality of vertical components and said plurality of horizontal components being spaced apart to provide said plurality of openings in said wall.

* * * * *